US005453552A

United States Patent [19]

Rice et al.

[11] Patent Number: 5,453,552

[45] Date of Patent: Sep. 26, 1995

[54] ISOMERIZATION AND ADSORPTION PROCESS WITH BENZENE SATURATION

[75] Inventors: Lynn H. Rice, Palatine; Robert S. Haizmann, Rolling Meadows, both of Ill.; Mark S. Turowicz, Woking, United Kingdom

[73] Assignee: UOP, Des Plaines, Ill.

[21] Appl. No.: 109,558

[22] Filed: Aug. 20, 1993

[51] Int. Cl.[6] ..... C07C 5/22; C07C 5/13; C07C 7/163

[52] U.S. Cl. ..... 585/253; 585/266; 585/737; 585/738

[58] Field of Search ..... 585/253, 734, 585/737, 738, 820, 266, 302

[56] References Cited

U.S. PATENT DOCUMENTS

| | | | |
|---|---|---|---|
| 4,113,789 | 9/1978 | Rao et al. | 260/683.68 |
| 4,210,771 | 7/1980 | Holcombe | 585/701 |
| 4,929,799 | 5/1990 | Holcombe et al. | 585/737 |
| 5,003,118 | 5/1991 | Low et al. | 585/253 |
| 5,082,989 | 1/1992 | Johnson | 585/748 |

*Primary Examiner*—P. Achutamurthy
*Attorney, Agent, or Firm*—Thomas K. McBride; John G. Tolomei

[57] ABSTRACT

An advantageous integration of benzene saturation for a light paraffin containing feedstock in a light paraffin isomerization and adsorption system maintains isomerization conversion while reducing benzene levels. The process improves the efficiency of the isomerization and saturation zones by saturating benzene from a light paraffin containing stream and adsorbing normal hydrocarbons from the saturation zone effluent stream together with normal hydrocarbons from an isomerization zone effluent. The isomerization zone effluent comprises converted hydrocarbons from a light paraffin containing feedstream having a relatively low benzene concentration. Saturating the high benzene feed in a first step of saturation and passing the low benzene containing feedstream through the isomerization zone independent of the benzene saturation removes normal hydrocarbons from the isomerization step to improve equilibrium and provides a gaseous phase for desorption and a heavier hydrocarbon phase for adsorption to improve product recovery and normal paraffin recovery.

16 Claims, 1 Drawing Sheet

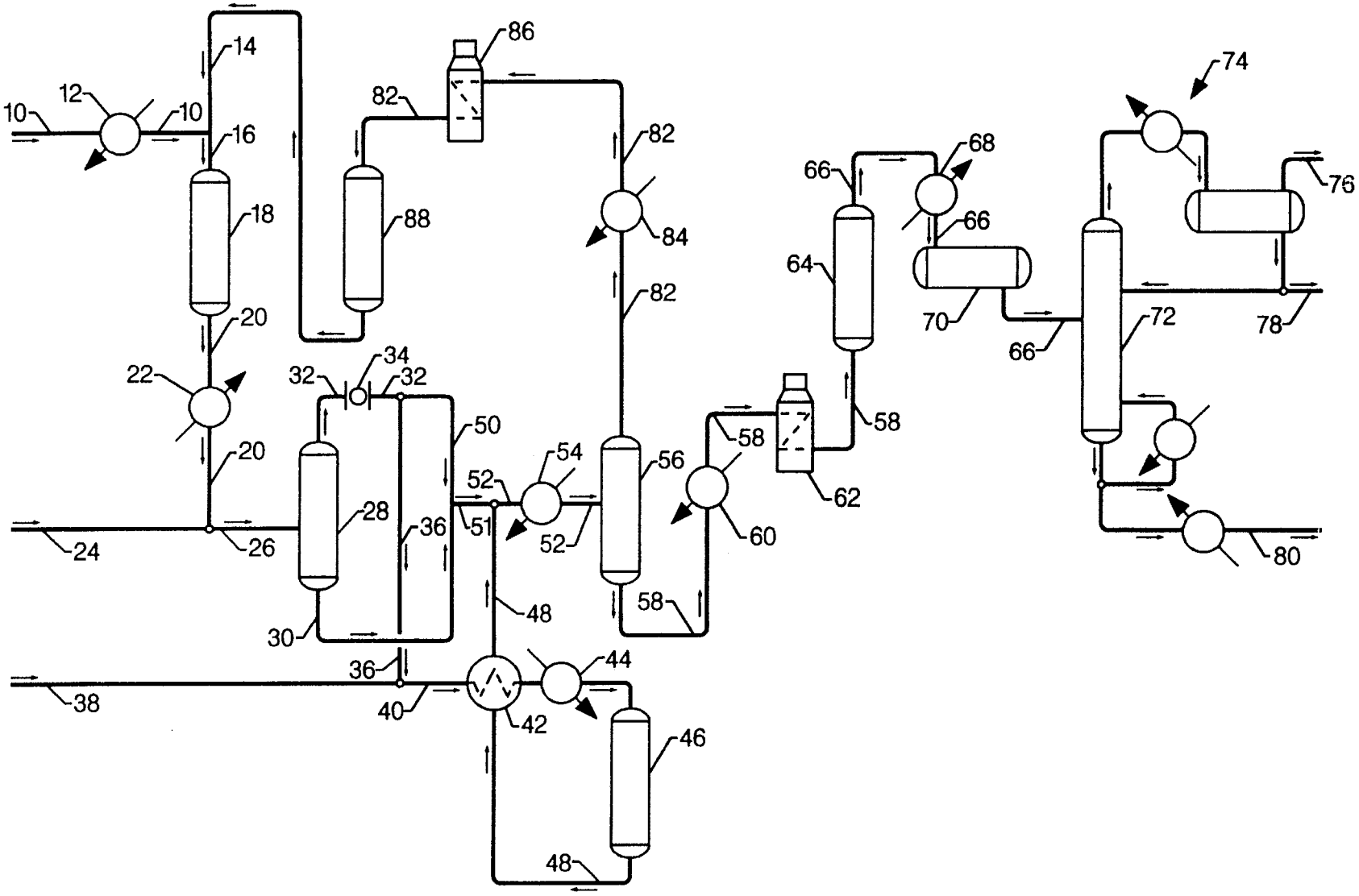
10
12
14
16
18
20
22
24
26
28
30
32
34
36
38
40
42
44
46
48
50
51
52
54
56
58
60
62
64
66
68
70
72
74
76
78
80
82
84
86
88

ISOMERIZATION AND ADSORPTION PROCESS WITH BENZENE SATURATION

BACKGROUND OF THE INVENTION

1. Field of the Invention

This invention relates to the processing of mixed hydrocarbon gasoline feedstocks to improve octane ratings. More specifically, the process uses integrated steps of adsorption, isomerization, and saturation to catalytically isomerize normal paraffin hydrocarbons, to concentrate non-normal hydrocarbons in a product stream, and to saturate aromatic hydrocarbons to meet benzene product limits.

2. Description of the Prior Art

Recent concerns about volatility and toxicity of hydrocarbon fuel and the resultant environment damage has prompted legislation that will limit the content and composition of aromatic hydrocarbons in such fuels. Many of these limitations relate specifically to benzene which, due to its toxicity, will be substantially eliminated from the gasoline pool. These new fuels are generally referred to as reformulated gasolines. New requirements for reformulated gasoline have profound impacts on the operation of refinery processes for producing high octane fuels. Reformulated gasoline requirements impose limitations on gasoline end points, benzene as well as total aromatics, and reid vapor pressure (RVP).

Benzene reduction will disrupt the current operation methods of several hydrocarbon processes that produce high octane fuel. Benzene reduction poses some of the most severe problems for the operation of catalytic reformers that have been relied on to raise the octane of unleaded fuels. Reformers that were typically operated at high severity to produce high octane benzene and aromatic hydrocarbons must now be operated to eliminate benzene and reduce aromatics. Reforming converts the $C_6$ and heavier hydrocarbons to aromatic compounds. Octane improvement is also obtained by catalytically isomerizing the paraffinic hydrocarbons to rearrange the structure of the paraffinic hydrocarbons into branch-chained paraffins such as normal $C_5$ hydrocarbons which are not readily converted into aromatics. Although the non-cyclic $C_6$ and heavier hydrocarbons can be upgraded into aromatics through dehydrocyclization, the conversion of $C_6$'s to aromatics creates higher density species and increases gas yields with both effects leading to a reduction in liquid volume yields. Therefore, it is preferable to charge the non-cyclic $C_6$ paraffins to an isomerization unit to obtain $C_6$ isoparaffins hydrocarbons. Consequently, octane upgrading commonly uses isomerization to convert normal $C_6$ and lighter boiling hydrocarbons and reforming to convert $C_6$ cycloparaffins and higher boiling hydrocarbons. However, both reforming and isomerization processes streams often require treatments for benzene elimination.

Elimination of benzene can be accomplished by removing benzene or benzene precursors from hydrocarbons prior to hydrocarbon conversion processes or removing benzene from the product stream by saturation, separation or conversion. Methods for eliminating benzene from a reforming effluent include direct saturation or saturation through isomerization. It is well known to eliminate benzene by direct saturation of product or feed streams such as an isomerization zone feed. U.S. Pat. No. 5,003,118 teaches a process for the directly saturating benzene in a benzene saturation reactor and passing the remainder of the stream as feed to an isomerization zone.

The benzene contribution from the reformate portion of the gasoline pool can also be decreased or eliminated by altering the operation of the reforming section. There are a variety of ways in which the operation of the reforming section may be altered to reduce the reformate benzene concentration. Changing the cut point of the naphtha feed split between the reforming and isomerization zones from 180° to 200° F. will remove benzene, cyclohexane and methylcyclopentane from the reformer feed. Benzene can alternately also be removed from the reformate product by splitting the reformate into a heavy fraction and a light fraction that contains the majority of the benzene. Practicing either method will put a large quantity of benzene into the feed to other processing units, particularly the isomerization zone. Therefore, it is necessary to have an efficient and cost effective means for removing benzene from feeds.

The saturation of benzene for an isomerization process imposes several costs and process drawbacks. Where a saturation effluent from a benzene saturation reactor passes directly to isomerization reactors, the effluent must be brought to the isomerization reactor pressure. In addition for water sensitive catalysts, the hydrogen used in the benzene saturation must also undergo drying to keep water out of the feed to the isomerization reactors. When the concentration of benzene that requires isomerization increases, additional drying and compressor cost become significant due to the high relative hydrogen requirements to satisfy the stoichiometric requirements for benzene saturation. In addition, the heat integration important to isomerization reactors does not permit full recovery of the heat of reaction released in the benzene saturation reactor. In fact, high benzene concentrations in the isomerization feed result in excessive temperatures that interfere with the isomerization process by producing coking, poor selectivity, and short catalyst cycles. Therefore, it is desirable to eliminate benzene from the feed to the isomerization zone.

Technology for isomerizing hydrocarbons is well known and often uses a series of adsorbers to remove non-normals in the production of a normal hydrocarbon-rich recycle stream that returns to the isomerization zone. Operations of this type are well known and described in U.S. Pat. No. 4,929,799, the contents of which are hereby incorporated by reference.

It is an object of this invention to provide an integrated process for the saturation of benzene, isomerization of light paraffins, and adsorptive enrichment of a normal hydrocarbon recycle stream, that operates with greater efficiency and effectiveness than over those of the prior art.

It is a further object of this invention to provide a process for raising the octane of gasoline range naphtha streams by isomerization, adsorption, and benzene saturation without raising temperatures in the isomerization reaction zone.

BRIEF SUMMARY OF THE INVENTION

This invention is based on the discovery of an advantageous integration of benzene saturation for a light paraffin containing feedstock in a light paraffin isomerization and adsorption system. The process improves the efficiency of the isomerization and saturation zones by saturating benzene from a light paraffin containing stream and adsorbing normal hydrocarbons from the saturation zone effluent stream together with an isomerization zone effluent comprising converted hydrocarbons from a light paraffin containing feedstream having a relatively low benzene concentration. Saturating the high benzene feed in a first step of saturation and passing the low benzene containing feedstream through the isomerization zone independent of the benzene saturation removes normal hydrocarbons from the isomerization step to improve equilibrium and provides a gaseous phase for desorption and a heavier hydrocarbon phase for adsorption to improve product recovery and normal paraffin recovery for recycle to the isomerization zone.

This invention is particularly useful in processing full boiling range naphthas. By the method of this invention, a light straight-run naphtha stream—with an end point well below benzene—passes directly to an isomerization reactor in an isomerization reaction zone. The remainder of the naphtha cut, including benzene and a substantial amount of normal hexane, passes to a reforming zone. The effluent from the reforming zone, containing a high concentration of benzene, is split into a lower boiling fraction containing essentially all the benzene and some $C_7$ hydrocarbons and a higher boiling fraction for gasoline blending. The lower boiling reformate effluent fraction passes directly into a benzene saturation reactor. The effluent from the benzene saturation reactor, after any recovery of light ends, passes into an adsorbtion zone along with the effluent from the isomerization reactor. The adsorption zone separates $C_5$ and $C_6$ isoalkanes along with most $C_7$ hydrocarbons by adsorbing $C_6$-normal hydrocarbons. The adsorbed $C_6$-hydrocarbons are desorbed in a normal hydrocarbon-rich recycle stream that passes to the isomerization reactor. Thus the arrangement of this process provides additional normal hydrocarbons from the reformate effluent for isomerization while preserving the cyclo-paraffins and iso-paraffins of the reformate. The elimination of iso-paraffins from the isomerization zone feed is particularly beneficial since the reforming zone already establishes a favorable equilibrium between the iso-paraffins and the normal paraffins. In addition, this invention facilitates the recovery of essentially all of the benzene for processing through the saturation zone. In order to recover all of the benzene, a relatively high end point must be set for the benzene-containing fraction. The high end point overlaps the boiling range of many $C_7$ iso-paraffins. Passing the saturation zone effluent stream through the adsorption zone removes essentially all of the $C_7$ hydrocarbons that would otherwise be lost to cracking in the isomerization zone.

Accordingly, in one embodiment this invention is a process for the isomerization of high benzene-containing feedstreams. The process includes passing a first feedstream comprising benzene and saturated $C_6$ hydrocarbons to a benzene saturation zone. The benzene saturation zone contacts the first feedstream with a benzene saturation catalyst at benzene saturation conditions to produce a saturated feed fraction. A second feedstream, comprising $C_5$ hydrocarbons, admixes with a recycle stream comprising normal hydrocarbons to produce a combined feedstream. The combined feedstream contacts an isomerization catalyst at isomerization conditions in an isomerization zone to produce an isomerization effluent. The isomerization zone effluent undergoes separation into a stream comprising hydrogen and a first liquid fraction comprising normal and branched alkanes. At least a portion of the saturated feed fraction, and at least a portion of the liquid fraction passes, as an adsorption feed, to an adsorption zone that contacts the adsorption feed at adsorption conditions with an adsorbent selective for normal hydrocarbons to produce an adsorbent retaining normal hydrocarbons and an isomerization zone product stream comprising branched $C_5$ and $C_6$ hydrocarbons. At least a portion of the desorption stream passes to the adsorption zone, which has retained normal hydrocarbons, and desorbs the normal hydrocarbons to produce the recycle stream.

In a more limited embodiment, this invention is a process for the isomerization of feedstreams containing benzene and $C_5$ and $C_6$ alkanes. The process includes the steps of combining a first feed stream comprising $C_5$ and $C_6$ hydrocarbons and having a benzene concentration of less than 3 mol % with a recycle stream comprising $C_5$ and $C_6$ normal hydrocarbons and hydrogen to produce a combined feedstream and passing the combined feedstream to an isomerization zone and contacting the combined feed with an isomerization catalyst at isomerization conditions to produce an isomerization effluent; separating the isomerization zone effluent into a first gas stream comprising hydrogen and a first liquid fraction containing normal and branched alkanes; combining at least a portion of the first gas stream with a second feed stream comprising $C_6$ and $C_7$ hydrocarbons and having a benzene concentration of at least 3 mol % to produce a saturator feed stream; contacting the saturator feed stream with a benzene saturation catalyst at benzene saturation conditions in a benzene saturation zone and recovering a saturated feed fraction; combining at least a portion of the saturated feed fraction, a portion of the first gas stream, and at least a portion of the first liquid fraction to produce a recontactor feed; separating at least a portion of the recontactor feed in a recontacting zone into an adsorption feed and a second gas stream; passing at least a portion of the adsorption zone feed to an adsorption zone at adsorption conditions and contacting the adsorption feed with an adsorbent having a selectivity for normal hydrocarbons to retain normal hydrocarbons in the adsorption zone and produce an isomerization zone product stream comprising branched $C_5$ and $C_6$ hydrocarbons and $C_7$ hydrocarbons; and, passing at least a portion of the desorption stream to the adsorption zone at desorption conditions, the adsorption zone retaining normal hydrocarbons in the selective void volume of the adsorbent, and desorbing normal hydrocarbons from the adsorbent to produce the recycle stream.

Other and further objects of the present invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

The FIGURE is a schematic flow diagram of one embodiment of the invention.

DETAILED DESCRIPTION OF THE INVENTION

The invention will be described primarily according to the preferred embodiment wherein a low benzene-containing hydrocarbon feedstock and a high benzene-containing hydrocarbon feedstock are processed to produce a high octane isomerate product.

Referring to the FIGURE, a light straight-run naphtha feed enters the process via line 10, is heated by exchanger 12, and passes into admixture with a recycle stream 14 to produce an isomerization zone feed carried by line 16 into isomerization reactor 18. The effluent from isomerization reactor 18 flows out through a line 20 that passes through a heat exchanger 22 for cooling the effluent stream. Effluent stream 20 combines with a makeup hydrogen stream carried by line 24 and passes as a combined input stream taken by line 26 into a receiver 28. Receiver 28 separates the combined input stream into a liquid hydrocarbon stream carried by line 30 and a gas stream taken by line 32.

After compression in compressor 34, line 36 withdraws a portion of the gas from line 32. The gas portion carried by line 36 admixes with a light reformate feed transported by line 38 to a produce a saturation feedstream charged by line 40 through heat exchangers 42 and 44 and into benzene saturation reactor 46. The saturated feed fraction transported by line 48 through exchanger 42 admixes with a stream 51 that contains liquid stream 30 and the remainder of gas stream 32 taken by line 50.

Combined streams from saturation reactor 46 and isomerization reactor 18 taken by a line 52 undergo recontacting. Line 52 passes the combined streams through an exchanger 54 and lowers the temperature of the combined streams before entering recontacting drum 56. Another liquid hydrocarbon stream comprising an adsorption feed fraction flows out of recontacting drum 56 through line 58 and passes through exchanger 60 and heater 62 before entering adsorption vessel 64. Adsorption vessel 64 retains normal hydrocarbons in the selective pore volume of an adsorbent. Remaining cycloparaffins and isoparaffins exit adsorption vessel 64 overhead through a line 66. Overhead stream 66 undergoes cooling in exchanger 68 and passes through drum 70 into a stabilizer 72. Stabilizer 72 has an overhead section 74 that provides a gas stream 76 and a liquefied petroleum gas stream 78. A product stream 80 exits the stabilizer as a stabilizer bottom stream.

An overhead stream from recontacting drum 56 passes overhead through a line 82. Exchanger 84 and heater 86 raise the temperature of the contents of line 82 which acts as a desorbent stream in an adsorption vessel 88 which, now operates in the desorption mode. Contact of the adsorbent in adsorbent vessel 88 desorbs previously adsorbed normal hydrocarbons to form recycle stream 14.

As the FIGURE demonstrates, in its most general form, the invention receives two feedstreams. These feedstreams can be independently obtained or they can be derived from a common feed source. A common feed source is a gasoline boiling range naphtha stream having boiling points in the range of from 70° to 180° F. At least a portion of the isomerization zone feed, enter the isomerization reactor directly. The other feedstream referred to as a benzene-containing the stream enters the isomerization zone via a benzene saturation reactor and the adsorption section of the integrated adsorption and isomerization sections.

The isomerization zone feedstream will usually have a relatively low benzene concentration. Benzene concentrations of less than 3 mol %, and more preferably less than 1 mol %, are preferred for this feedstream. One common source for this feedstream is a light straight-run naphtha fraction having an end point of from 70° to 180° F. Such streams will be rich in normal $C_5$ and $C_6$ hydrocarbons. The term "rich," as used herein, refers to a stream having a concentration equal to at least 50% of the specified components. Other sources for the isomerization zone feed include raffinate from an aromatics extraction process and light gasoline from a hydrocracking process.

The other hydrocarbon feed entering the process is the benzene-containing feed. At minimum, the benzene-containing feed will include normal $C_6$ hydrocarbons and a substantial concentration of benzene. In the benzene-containing feed, benzene will typically have concentrations of at least 3 wt. %, and more typically will have a concentration in a range of from 5 to 20 wt. %. Additional hydrocarbon species in the benzene-containing feed will normally include branched and normal $C_5$ and $C_7$ hydrocarbons. A typical source for the benzene-containing feed is a light fraction of a reformate effluent. Other sources for the benzene-containing feed include gasoline from a fluid catalytic cracking unit.

In a preferred form of this invention, the isomerization feed and the benzene-containing feed are derived from a full boiling range or from a gasoline boiling range naphtha stream. A light straight-run fraction of the naphtha feed having an end boiling point of about 180° F. serves as the isomerization zone feed. The remaining heavier portion of the naphtha feed enters a reforming zone. Processes for the reforming of hydrocarbons are well known to those skilled in the art and additional details may be found in U.S. Pat. Nos. 4,119,526; 4,449,095; 4,440,626; and 3,692,496; the contents of which are hereby incorporated by reference. The reforming zone typically isomerizes normal $C_5$ hydrocarbons to a favorable isopentane pentane equilibrium and produces significant quantities of benzene as well as $C_7$ and higher aromatics. Typically, separation of the reformate effluent into a light reformate feed having an end point in the boiling range of isoheptane provides the benzene-containing feed to the saturation reactor.

In most cases the process will also require a hydrogen containing feedstream that provides makeup hydrogen for the isomerization reactor and the benzene saturation reactor. Makeup hydrogen may enter the process with the benzene-containing feed, the isomerization feed, or in any of the stages of separation and recontacting as described herein. A hydrogen concentration is needed in both the benzene saturation reactor and the isomerization reactor. Makeup hydrogen can be supplied in impure form and is preferably supplied as an off gas from the catalytic reforming process associated with the preferred feedstream source.

The hydrogen and hydrocarbon feed mixture entering the isomerization zone is contacted in at least one reaction zone with an isomerization catalyst. This invention can be practiced using a variety of different catalyst compositions and is not limited to a particular catalyst or combination of catalysts for the isomerization zone.

One group of suitable isomerization catalysts comprise the crystalline zeolitic molecular sieves. Preferred catalysts of this type have an apparent pore diameter large enough to adsorb neopentane; a $SiO_2/Al_2O_3$ molar ratio of greater than 3; an equivalent percent of alkali metal cations that is less than 60 and preferably less than 15; and the $AlO_4$ —tetrahedra not associated with alkali metal cations either not associated with any metal cation or associated with divalent or other polyvalent metal cations.

Because the feedstock may contain some olefins and will undergo at least some cracking, the zeolitic catalyst is preferably combined with a hydrogenation catalyst component, preferably a noble metal group VIII of the Periodic classification of the Elements. The catalyst composition can be used alone or can be combined with a porous inorganic oxide diluent as a binder material. The hydrogenation agent can be carried on the zeolitic component and/or on the binder. A wide variety of inorganic oxide diluent materials are known in the art—some of which exhibit hydrogenation activity per se. It will, accordingly, be understood that the expression "an inorganic diluent having a hydrogenation agent thereon" is meant to include both diluents which have no hydrogenation activity per se and carry a separate hydrogenation agent and those diluents which are per se hydrogenation catalysts. Oxides suitable as diluents, which of themselves exhibit hydrogenation activity, are the oxides of the metals of Group VI of the Mendeleev Periodic Table of Elements. Representative of the metals are chromium, molybdenum and tungsten.

It is preferred that the diluent material posses no pronounced catalytic cracking activity. The diluent should not exhibit a greater quantitative degree of cracking activity than the zeolitic component of the overall isomerization catalyst composition. Suitable oxides of this latter class are the aluminas, silicas, the oxides of metals of Groups III, IV-A and IV-B of the Mendeleev Periodic Table, and cogels of silica and oxides of the metals of the Groups III, IV-A and IV-B, especially alumina, zirconia, titania, thoria and combinations thereof. Aluminosilicate clays such as kaolin, attapulgite, sepiolite, polygarskite, bentonite, montmorillonite, and the like, when rendered in a pliant plastic-like conditions by intimate admixture with water are also suitable diluent materials, particularly when said clays have not been acid-washed to remove substantial quantities of alumina.

Suitable zeolite catalysts for isomerization reactions are disclosed in detail in U.S. Pat. Nos. 3,236,761, 3,236,762 and 3,130,007. The catalyst of U.S. Pat. No. 3,130,007 is prepared from a zeolite Y having a $SiO_2/Al_2O_3$ molar ratio of about 5 by reducing the sodium cation content to less than about 15 equivalent percent by ammonium cation exchange, then introducing between about 35 and 50 equivalent percent of rare earth metal cations by ion exchange and thereafter calcining the zeolite to effect substantial dealumination. As a hydrogenation component, platinum or palladium in an amount of about 0.1 to 1.0 weight percent, can be placed on the zeolite by any conventional method. The disclosures of these above-cited U.S. patents are incorporated herein by reference.

Another possible isomerization catalyst consists of a high chloride catalyst on an alumina base containing platinum. In which case the alumina is preferably an anhydrous gamma-alumina with a high degree of purity. The catalyst may also contain other platinum group metals. The term platinum group metals refers to noble metals excluding silver and gold which are selected from the group consisting of platinum, palladium, germanium, ruthenium, rhodium, osmium, and iridium. These metals demonstrate differences in activity and selectivity such that platinum has now been found to be the most suitable for this process. The catalyst will typically contain from about 0.1 to 0.25 wt. % of the platinum. Other platinum group metals may be present in a concentration of from 0.1 to 0.25 wt. %. The platinum component may exist within the final catalytic composite as an oxide or halide or as an elemental metal. The presence of the platinum component in its reduced state has been found most suitable for this process.

The platinum catalyst also contains a chloride component. The chloride component termed in the art "a combined chloride" is present in an amount from about 2 to about 10 wt. % based upon the dry support material. The use of chloride in amounts greater than 4 wt. % have been found to be the most beneficial for this process.

There are a variety of ways for preparing the preferred catalytic composite and incorporating the platinum metal and the chloride therein. A suitable method for preparing the chloride platinum patent is described in U.S. Pat. No. 5,002,989, the contents of which are hereby incorporated by reference.

It is generally known that high chloride platinum-alumina catalysts are highly sensitive to sulfur and oxygen-containing compounds. Therefore, the feedstocks and any make-up hydrogen entering the isomerization must be relatively free of such compounds when such catalyst is used. A sulfur concentration no greater than 0.5 ppm is generally required. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_1$–$C_5$ oxygenates, that can decompose to form water, can only be tolerated in very low concentrations. In general, this requires a limitation of oxygenates in the feed to about 0.1 ppm or less. The feedstock and hydrogen stream may be treated by any method that will remove water and sulfur compounds. Sulfur may be removed from the feedstream by hydrotreating. A variety of commercial dryers are available to remove water from the feed components. Adsorption processes for the removal of sulfur and water from hydrocarbon streams are well known to those skilled in the art.

Operation of the isomerization zones with the chlorided catalyst also requires the presence of a small amount of organic chloride promoter. The organic chloride promoter serves to maintain a high level of active chloride on the catalyst as low levels are continuously stripped off the catalyst by the hydrocarbon feed. The concentration of promoter in the reaction zone is maintained at from 30 to 300 ppm. The preferred promoter compound is carbon tetrachloride. Other suitable promoter compounds include oxygen-free decomposable organic chlorides such as propyldichloride, butylchloride, methylenechloride, and chloroform to name only a few of such compounds. The need to keep the reactants dry is reinforced by the presence of the organic chloride compound which may convert, in part, to hydrogen chloride. As long as the process streams are kept dry, there will be no adverse effect from the presence of small amounts of hydrogen chloride.

Other suitable catalysts for the isomerization zone include sulfonated catalysts having a metal in the oxide form such as zirconium oxide. These catalysts are often referred to as "Super Acids" and are further described in U.S. Pat. Nos. 4,918,041 and 5,036,035.

Operating conditions within the isomerization zones are selected to provide a good selectivity of the particular isoalkane product from the feed components. The core of the operation is passage of the isomerization feedstock through a reactor at isomerization-promoting conditions including the presence of an acidic isomerization catalyst. This is normally a relatively low pressure operation performed at an elevated temperature as required by the activity of the catalyst. The average reactant temperature may be as high as 500° C., but is preferably between 90° and 320° C., and more preferably in about 230°–290° C. (450°–550° F.) are preferred when large quantities of normal butanes are in the combined feed to the $C_3$–$C_6$ isomerization zone. The higher temperatures offer a significant increase in isobutane production with only a minimal decrease in the ratio of $C_5$ and $C_6$ isoalkanes to pentane and hexane. Of course, the most suitable temperature will depend on the composition of the feed. For feeds having few isomerizable $C_4$ hydrocarbons, temperatures of between 120°–205° C. (248°–400° F.) may be most advantageous. The $C_5$–$C_6$ isomerization zone may also be maintained over a wide range of pressures. Pressure conditions in the isomerization $C_5$–$C_6$ paraffins range from 700 to 7000 kPag. Preferred pressures for this isomerization are in the range of from 2000 to 3000 kPag. The feed rate to this reaction zone can also vary over a wide range and includes liquid hourly space velocities ranging from 0.5 to 20 $hr.^{-1}$, however, space velocities between 0.5 and 4 $hr.^{-1}$ are preferred.

The isomerization zone will usually contain multiple stages. A typical $C_5$–$C_6$ isomerization zone will have a two-reactor system comprising a first stage reactor and a second stage reactor. The catalyst used in a multiple reaction stage system is usually distributed equally between the different reaction stages. It is not necessary that either reaction zone be carried out in two or more reactors but the use of at least two reactors confers several benefits on the process. Two reactors can also be used to maintain lower catalyst temperatures in a portion of the $C_5$–$C_6$ isomerization zone. This is accomplished by having any exothermic reaction such as hydrogenation of unsaturates performed in a first reaction vessel with the rest of the reaction carried out in a final reactor stage at lower temperature conditions. Therefore, the first reactor can operate at a somewhat higher temperature which favors the isomerization of butanes and the lower temperature of the second reactor will increase the $C_5$ and $C_6$ isoparaffin to paraffins ratios by a small amount without reversing the isobutane yield. When two reactors are used in this manner, the last reactor in the isomerization zone can be operated at a temperature below 190° C. (375° F.) and possibly as low as 150° C. (302° F.)

Another hydrogen containing stream, typically produced by a hereinafter described product separator zone, enters the benzene saturation zone with the benzene containing stream. The usual benzene saturation zone of this invention contacts the feed with a hydrogenation catalyst. The saturation zone will typically comprise a fixed bed of catalyst for promoting the hydrogenation of benzene. Suitable hydrogenation catalysts will provide a metallic function to promote hydrogen transfer without any substantial acid function that would lead to undesirable cracking. Preferred catalyst compositions will include platinum group, tin or cobalt and molybdenum metals on suitable refractory inorganic oxide supports such as alumina. The alumina is preferably an anhydrous gamma-alumina with a high degree of purity. The term platinum group metals refers to noble metals excluding silver and gold which are selected from the group consisting of platinum, palladium, germanium, ruthenium, rhodium, osmium, and iridium.

Such catalyst will provide satisfactory benzene saturation at the operating conditions of this invention. The operating conditions include temperatures of from 350° to 600° F., preferably from 500° F. to 550° F., pressures of from 300 to 700 psig, preferably from 400 to 500 psig, and a liquid hourly space velocity (LHSV), of from 1 to 20 preferably from 4 to 12.

A particularly preferred catalyst for the saturation zone comprises a platinum metal on an alumina support. In its preferred form, the alumina support will comprise spheres having a nominal diameter of about 1/16 and surface area of from about 160 to 200 $m^2/g$ with an apparent bulk density of from about 0.45 to 0.6. The platinum metal may be present on the catalyst in a concentration of from 0.1 to 1 wt. % and preferably in a concentration of from 0.375 to 0.75 wt. %.

The hydrogenation zone catalyst is often sulfur sensitive. Suitable guard beds or adsorptive separation processes may be used to reduce the sulfur concentration of the feedstock. Preferably the sulfur in the feed to the saturation zone will have a sulfur concentration of less than 0.1 ppm.

Consumption of hydrogen in the saturation zone increases the required amount of hydrogen admixed with the feedstock. This process preferably seeks to minimize the hydrogen to hydrocarbon ratio in the saturation zone. Therefore, hydrogen will usually be mixed with the feedstock in an amount sufficient to create a combined feed having a hydrogen to hydrocarbon ratio of from 0.1 to 10. Low hydrogen to hydrocarbon ratios keep the system and equipment associated with the addition of hydrogen simple. At minimum, the hydrogen to hydrocarbon ratio must supply the stoichiometric requirements for the saturation reaction.

After any heat exchange, the effluents from the isomerization zone and the benzene saturation zone are combined in an effluent separation section. The effluent separation section at least divides the isomerization zone effluent zone into a product stream comprising $C_4$ and heavier hydrocarbons and a gas stream comprising lighter hydrocarbons and hydrogen. The effluent from the benzene saturation reactor also undergoes at least one stage of separation to remove light hydrogen containing gases from a liquid stream containing product.

The FIGURE depicts the preferred arrangement for this separation where the isomerization zone effluent stream, in combination with the makeup hydrogen, passes through a receiver that produces a receiver bottoms stream and a receiver overhead gas stream. After compression of the receiver overhead gas stream, a portion of this hydrogen containing gas stream passes to the benzene saturation reactor to provide the hydrogen reactant. The remainder of the compressed hydrogen is recontacted with the liquid bottoms from the receiver and further combined with the effluent from the benzene saturation zone. Recontacting of separated gas stream with the liquid from the bottom of the receiver provides additional recovery of normally liquid products. Recompression of the overhead gas stream from the receiver enables the benzenes saturation reactor to operate at higher pressure. The recontacted light gas and liquid stream in combination with the benzene saturation reactor effluent enter the recontacting drum to separate a light hydrogen containing gas from a liquid stream containing product.

Both the light hydrogen containing gas and the liquid product are used as sequential inputs to an adsorption zone. The adsorption zone separates normal paraffins from isoparffins and cycloparaffins using a molecular sieve. The molecular sieve, typically a zeolite, employed in the adsorption bed must be capable of selectively adsorbing the normal paraffins of the feedstock using molecular size and configuration as the criterion. Such a molecular sieve should, therefore, have an apparent pore diameter of less than about 6 Angstroms and greater than about 4 Angstroms. A particularly suitable zeolite of this type is zeolite A, described in U.S. Pat. No. 2,883,243, which in several of its divalent exchanged forms, notably the calcium cation form, has an apparent pore diameter of about 5 Angstroms, and has a very large capacity for adsorbing normal paraffins. Other suitable molecular sieves include zeolite R, U.S. Pat. No. 3,030,181; zeolite T, U.S. Pat. No. 2,950,952, and the naturally occurring zeolitic molecular sieves chabazite and entireties. These U.S. patents are incorporated by reference herein in their entireties.

The term "apparent pore diameter" as used herein may be defined as the maximum critical dimension, or the molecular species which is adsorbed by the adsorbent under normal conditions. The critical dimension is defined as the diameter of the smallest cylinder which will accommodate a model of the molecule constructed using the available values of bond distances, bond angles and van der Waals' radii. The apparent pore diameter will always be larger than the structural pore diameter, which can be defined as the free diameter of the appropriate silicate ring in the structure of the adsorbent.

It is known that ion-exchanged clinoptilolites particularly, NaK clinoptilolite, acid washed Ba clinoptilolite, MgK clinoptilolite, acid leached clinoptilolite, $NH_4$ clinoptilolite, etc. are particularly suitable for use when the isomerization catalyst is chloride. Clinoptilolite as an adsorbent with adjustable pore size and acid resistance is described in U.S. Pat. No. 4,935,580 issued to Chao et al., U.S. Pat. No. 4,964,889 issued to Chao, and U.S. Pat. No. 5,164,076 issued to Zarchy, Chao and Correia, the contents of which are hereby incorporated by reference. For NaK and MgK clinoptilolite, the preferred concentration of potassium ions is in the range of 15 to 75%, and more preferably in a range of 30 to 70%, and the concentration of Na and Mg are preferably in a range of 25 to 85% and more preferably in a range of 30 to 70%. The sum of Na and K or Mg and K are in the range of 50 to 100% of the total ion exchange capacity of the adsorbent. For Ba clinoptilolite, the barium concentration should be in the range of 20 to 100% of the ion exchange capacity. Other useful compositions include K, Na, Li, H, Mg, Ca, Sr, Zn, Mn, Co, CaK, SrK, ZnK, MnK, CoK and BaK cation exchanged or naturally occurring clinoptilolites and their acid washed version with the intended cations accounting for 50 to 100% of the total ion-exchange capacity of the clinoptilolite.

Preferably, the adsorbents in the adsorbent beds have effective pore diameters of substantially 5 Angstroms. The term "bed void space" for purposes of this description means any space in the bed not occupied by solid material except the intracrystalline cavities of the zeolite crystals. The pores within any binder material which may be used to form agglomerates of the zeolite crystals is considered to be bed void space.

The two adsorbent beds shown in the system of the FIGURE, each cyclically undergo the two stages of adsorption and desorption. In adsorption, the adsorber preferably mixed the hydrogen prior to introducing it to the feed end of the adsorber, then adsorbed, with product and hydrogen being withdrawn from the effluent end of the adsorber. In desorption, hydrogen in the recovered gas stream is preferably used to desorb the bed in a direction countercurrent to the feed and the total effluent is sent to the isomerization reactor as recycle for admixture with the isomerization zone feed. Additional details of the adsorption and desorption steps can be obtained from U.S. Pat. No. 4,929,799 the contents of which are hereby incorporated by reference.

In the instant process adsorption and desorption are typically carried out in at least two adsorption vessels with one vessel working on adsorption while the other vessel operates on desorption. On the adsorption side, adsorption of normal paraffins in the feed continues as non-normals emerge from the bed and pass on to further separation. Simultaneously, desorption is occurring using the heated hydrogen stream from the recontacting drum. Once the adsorbent in the adsorption zone is loaded to a desirable degree, preferably before breakthrough of normal paraffins into the effluent from the adsorption vessel undergoing adsorption, the adsorption step in that bed ceases and the bed undergoes desorption steps. Similarly, desorption of the adsorbent in an adsorbent vessel containing adsorbed hydrocarbons takes place in the desorption step. Throughout the desorption step the previously adsorbed normal hydrocarbons are desorbed, recycled, and admixed with isomerization feed to increase the quantity of normal hydrocarbons passing through the isomerization zone. In addition to adsorption and desorption, an adsorbent vessel may also undergo steps of purging, repressurization, and equalization, which steps are well known to those skilled in the art.

Non-normals that pass through the adsorption zone enter a further stage of separation for the recovery of isomerate product. The isomerization zone product will typically have a benzene concentration of less than 0.1 mol %. Common arrangements of the separation facilities divide the reaction zone effluent into a product stream comprising $C_4$ and heavier higher carbons and a gas stream. Suitable designs for rectification columns in separator vessels are well known to those skilled in the art. Product separation facilities may also be arranged as shown in the FIGURE to provide a fuel gas stream and a liquefied petroleum gas stream in addition to the isomerate product.

EXAMPLE

This example illustrates the operation of a process essentially as shown in the FIGURE. The process design for this example is based on a charge rate of 5000 BPSD of a light straight run naphtha containing predominantly $C_5/C_6$ hydrocarbons and 3000 BPSD a light reformate stream containing benzene as described in the Table below, which also describes principal process streams. This example is based on Engineering Calculations and operating data from similar units.

A starting point is selected at the recontact drum outlet stream 82. This stream is preheated in exchanger 84. The outlet temperature of the gas is maintained at 350° F. The gas is then heated to 510° F. in furnace 86. From furnace 86, the hot hydrogen passes downflow through one adsorber (in this case 88), and strips the adsorbed normals from the molecular sieve adsorbent. Hot desorption effluent (stream No. 14) is then sent to the isomerization reactor 18. The composition of the total isomerization feed stream is shown in the Table for line 16.

In the isomerization reactor, the normal paraffins are partially converted to isoparaffins. An improved distribution of isohexanes is also achieved by increasing the concentration of the more highly branched dimethylbutanes. Some ring opening of naphtenes, hydrogenation of aromatics, and cracking of the hydrocarbons to butanes and lighter also occur. The reactor effluent is split into the gas stream and the liquid stream. A slight excess of hydrogen is passed to the saturation reactor to ensure benzene saturation. 82 lb mol per hour of gas stream 32 passes to the saturation reactor in combination with the feed 38. After cooling the combined streams from receiver 28 and saturation reactor 46 are split by recontact drum 56. The liquid stream from recontact drum 56 enters the adsorber 64 at a temperature of about 500° F. The adsorption effluent is cooled and undergoes separation in stabilizer 72 to provide the product streams listed in the table. A heated gas stream from the recontacting drum desorbs normal hydrocarbons from adsorption vessel 88 to provide recycle to the isomerization reactor and complete the process steps.

The above description teaches those of ordinary skill in the art how to practice the present invention and is not intended to detail all of the obvious modifications and variations which, upon reading the description, are apparent to those skilled in the art. Nevertheless, all such modifications and variations are included within the scope of the present invention as defined by the following claims.

| COMPOSITION LB MOL/HR | Stream Numbers 10 Fresh Feed to Isomerization Unit | 38 Fresh Feed to Saturation Reactor | 16 Total Isomerization Feed | 26 Receiver Input | 48 Saturation Effluent | 52 Contactor Input | 78 LPG Product | 80 Isomerate |
|---|---|---|---|---|---|---|---|---|
| Hydrogen | | | 990.2 | 4268.4 | 20.1 | 4198.2 | 0.2 | |
| Methane | | | 113.9 | 126.2 | 2.0 | 124.2 | 0.2 | |
| Ethane | | | 35.0 | 40.3 | 0.6 | 43.0 | 1.4 | |
| Propane | | | 27.9 | 40.0 | 0.5 | 44.2 | 17.1 | |
| Isobutane | 4.9 | | 21.5 | 36.3 | 0.3 | 36.2 | 12.5 | |
| Normal Butane | 15.4 | 1.0 | 47.7 | 252.8 | 3.1 | 253.2 | 7.4 | 9.3 |
| Isopentane | 157.6 | 105.0 | 382.6 | 675.6 | 108.2 | 778.8 | 0.5 | 541.9 |
| Normal Pentane | 197.0 | 106.2 | 717.1 | 436.7 | 108.1 | 541.5 | — | 20.4 |
| Cyclopentane | 11.5 | 3.7 | 15.6 | 13.4 | 3.7 | 17.0 | | 12.8 |
| 2,2 Dimethylbutane | 1.6 | 7.6 | 18.0 | 63.8 | 7.8 | 71.3 | | 54.4 |
| 2,3 Dimethylbutane | 6.6 | 10.6 | 15.8 | 33.0 | 10.7 | 43.5 | | 34.0 |
| 2-Methylpentane | 69.8 | 54.1 | 106.9 | 125.4 | 54.4 | 179.0 | | 141.0 |
| 3-Methylpentane | 36.3 | 31.2 | 59.0 | 81.3 | 31.3 | 112.2 | | 88.8 |
| Normal Hexane | 82.5 | 24.2 | 184.3 | 79.5 | 24.4 | 203.5 | | 1.7 |
| Methylcyclopentane | — | 3.1 | 4.9 | 21.7 | 3.1 | 24.7 | | 19.7 |
| Cyclohexane | 19.7 | — | 24.6 | 6.5 | 16.7 | 25.2 | | 20.2 |
| Benzene | 12.1 | 18.7 | 12.5 | 0.01 | 2.0 | 2.0 | | 1.6 |
| Isoheptane | 2.4 | 3.1 | 3.1 | 1.6 | 3.1 | 4.7 | | 3.9 |
| Normal Heptane | — | — | — | — | — | — | | — |
| Total | 617.4 | 368.5 | 2,980.6 | 6,302.5 | 400.1 | 6,702.4 | 39.3 | 949.7 |

We claim:

1. A process for the isomerization of high benzene containing feed streams comprising:

a) passing a first feedstream comprising benzene and saturated $C_6$ hydrocarbons and hydrogen to a benzene saturation zone and contacting said first feedstream with a benzene saturation catalyst at benzene saturation conditions in said benzene saturation zone and recovering a saturated feed fraction;

b) combining a second feed stream comprising $C_5$ hydrocarbons and having a lower benzene concentration than said first feedstream with a recycle stream comprising normal hydrocarbons from said saturated feed fraction to produce a combined feedstream and passing said combined feedstream to an isomerization zone and contacting said combined feed with an isomerization catalyst at isomerization conditions to produce an isomerization effluent;

c) separating said isomerization zone effluent into a desorption stream comprising hydrogen and a first liquid fraction comprising normal and branched alkanes;

d) combining at least a portion of said saturated feed fraction and at least a portion of said first liquid fraction as an adsorption feed and passing said adsorption feed to an adsorption zone at adsorption conditions and contacting said adsorption feed with an adsorbent having a selectivity for normal hydrocarbons to retain normal hydrocarbons in said adsorption zone and produce an adsorption zone effluent stream comprising branched $C_5$ and $C_6$ hydrocarbons; and, e) passing at least a portion of said desorption stream to said adsorption zone at desorption conditions, said adsorption zone containing said adsorbent having a selectivity for normal hydrocarbons and retaining normal hydrocarbons in the selective void volume of said adsorbent, and desorbing normal hydrocarbons from said adsorbent to produce said recycle stream.

2. The process of claim 1 wherein said first stream feed stream includes $C_7$ hydrocarbons and the majority of said $C_7$ hydrocarbons pass through said adsorption zone at adsorption conditions.

3. The process of claim 1 wherein said first feedstream comprises $C_6$ hydrocarbons from a reforming zone effluent.

4. The process of claim 1 wherein said second feedstream is a light straight run naphtha stream comprising $C_5$ and $C_6$ hydrocarbons.

5. The process of claim 3 wherein a light straight run naphtha stream is split into a first fraction comprising $C_5$ and $C_6$ hydrocarbons to provide said second feedstream and a second fraction comprising $C_6$ and $C_7$ hydrocarbons, said second fraction passes to a reforming zone, a reforming zone effluent stream is recovered from said reforming zone, and at least a portion of said reforming zone effluent stream provides said first feedstream.

6. The process of claim 1 wherein said isomerization effluent is separated in a receiver to produce a gas stream comprising hydrogen and a second liquid stream comprising normal and branched alkanes, a portion of said gas stream passes to said benzene saturation zone to provide hydrogen to said benzene saturation zone, a portion of said gas stream is combined with at least a portion of said second liquid stream and at least a portion of said saturated feed fraction to produce a recontactor feed, and said recontactor feed is separated in a recontacting vessel into said desorption stream and said first liquid fraction.

7. The process of claim 1 wherein said saturation reactor operates at a temperature of 350° to 600° F.

8. The process of claim 1 wherein said first feed stream has a benzene concentration of at least 3 mol %.

9. The process of claim 1 wherein said second feedstream has a benzene concentration of less than 3 mol %.

10. The process of claim 1 wherein said first feed stream has a benzene concentration of between 5 and 20 mol %.

11. The process of claim 1 wherein said isomerization zone product stream has a benzene concentration of less than 0.1 mol %.

12. A process for the isomerization of high benzene containing feed streams comprising:

a) combining a first feed steam comprising $C_5$ and $C_6$ hydrocarbons and having a benzene concentration of less than 3 mol % with a recycle stream comprising $C_5$ and $C_6$ normal hydrocarbons and hydrogen to produce a combined feedstream and passing said combined feedstream to an isomerization zone and contacting said combined feed with an isomerization catalyst at isomerization conditions to produce an isomerization effluent;

b) separating said isomerization zone effluent into a first gas stream comprising hydrogen and a liquid fraction comprising normal and branched alkanes;

c) combining at least a portion of said first gas stream with a second feed stream comprising $C_6$ and $C_7$ hydrocarbons and having a benzene concentration of at least 3 mol % to produce a saturator feed stream;

d) contacting said saturator feed stream with a benzene saturation catalyst at benzene saturation conditions in a benzene saturation zone and recovering a saturated feed fraction;

e) combining at least a portion of said saturated feed fraction, a portion of said first gas stream, and at least a portion of said liquid fraction to produce a recontactor feed;

f) separating at least a portion of said recontactor feed in a recontacting zone into an adsorption feed and a second gas stream;

g) passing at least a portion of said adsorption feed to an adsorption zone at adsorption conditions and contacting said adsorption feed with an adsorbent having a selectivity for normal hydrocarbons to retain normal hydrocarbons in said adsorption zone and produce an isomerization zone product stream comprising branched $C_5$ and $C_6$ hydrocarbons; and, h) passing at least a portion of said second gas stream to said adsorption zone at desorption conditions, said adsorption zone containing said adsorbent having a selectivity for normal hydrocarbons and retained normal hydrocarbons in the selective void volume of said adsorbent, and desorbing normal hydrocarbons from said adsorbent to produce said recycle stream wherein said recycle stream contains normal hydrocarbons from said saturated feed fraction.

13. The process of claim 12 wherein a light straight run naphtha stream is split into a first fraction comprising $C_5$ and $C_6$ hydrocarbons to provide said first feedstream and a second fraction comprising $C_6$ and $C_7$ hydrocarbons that passes to a reforming zone, a reforming effluent stream is recovered from said reforming zone and at least a portion of said reforming zone effluent stream provides said second feedstream.

14. The process of claim 12 wherein said saturation reactor operates at a temperature of 350° to 600° F.

15. The process of claim 12 wherein said second feed stream has a benzene concentration of between 5 and 20 mol%.

16. The process of claim 12 wherein said isomerization zone product stream has a benzene concentration of less than 0.1 mol %.

* * * * *